US006606477B2

(12) United States Patent
Thompson et al.

(10) Patent No.: US 6,606,477 B2
(45) Date of Patent: Aug. 12, 2003

(54) METHOD TO CONTROL PRE- AND POST-NIP FIELDS FOR TRANSFER

(75) Inventors: Michael D. Thompson, Rochester, NY (US); Christopher A. DiRubio, Webster, NY (US); Gerald M. Fletcher, Pittsford, NY (US); Charles A. Radulski, Macedon, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/683,538

(22) Filed: Jan. 16, 2002

(65) Prior Publication Data

US 2003/0133729 A1 Jul. 17, 2003

(51) Int. Cl.[7] ..... G03G 15/16
(52) U.S. Cl. ..... 399/313; 399/297
(58) Field of Search ..... 399/66, 297, 302, 399/308, 310, 313, 314, 316

(56) References Cited

U.S. PATENT DOCUMENTS

| | | | | | |
|---|---|---|---|---|---|
| 2,807,233 | A | | 9/1957 | Fitch | |
| 3,781,105 | A | | 12/1973 | Meagher | |
| 3,830,589 | A | | 8/1974 | Allen | |
| 3,832,053 | A | * | 8/1974 | Goel et al. | 399/314 X |
| 3,832,055 | A | | 8/1974 | Hamaker | |
| 3,936,174 | A | | 2/1976 | Carpenter | |
| 5,276,490 | A | * | 1/1994 | Bartholmae et al. | 399/313 X |
| 5,303,013 | A | * | 4/1994 | Koike et al. | 399/302 |
| 5,583,623 | A | * | 12/1996 | Bartholmae et al. | 399/310 |
| 5,697,034 | A | * | 12/1997 | Iwakura et al. | 399/313 |
| 6,075,965 | A | * | 6/2000 | Tombs et al. | 399/308 |
| 6,203,743 | B1 | * | 3/2001 | Reese | |

* cited by examiner

*Primary Examiner*—Sandra Brase
(74) *Attorney, Agent, or Firm*—Oliff & Berridge, PLC

(57) ABSTRACT

Electrodes are embedded in a biased transfer roller for the transfer of a xerographic image. The electrodes, which run the length of the roller, are deposited on an insulating core surrounding the shaft. A conformable semi-conductive layer of a flexible elastomer covers the embedded electrodes. The semi-conductive layer limits current flow between embedded electrodes, relaxes charge deposited on the roller surface, and maximizes the electric field that attracts the toner from the photoconductor to the image receiving surface (substrate or intermediate). The electroded biased transfer roller may tailor the electric fields within the nip, pre-nip, and post-nip regions between the photoreceptor and the image receiving surface of the xerographic device.

22 Claims, 2 Drawing Sheets

METHOD TO CONTROL PRE- AND POST-NIP FIELDS FOR TRANSFER

BACKGROUND OF THE INVENTION

1. Field of Invention

The present invention relates generally to biased transfer rollers for high speed xerographic printing, and more particularly, to biased transfer rollers with commutated longitudinal electrodes embedded below the surface of the roller to control pre-nip and post-nip fields for image transfer.

2. Description of Related Art

Typically, electrostatic imaging and printing processes are comprised of several distinct stages. These stages may generally be described as (1) charging, (2) imaging, (3) exposing, (4) developing, (5) transferring, (6) fusing, and (7) cleaning. In the charging stage, a uniform electrical charge is deposited on the surface of a photoreceptor so as to electrostatically sensitize the surface. Imaging converts the original image into a projected image exposed upon the sensitized photoreceptor surface. An electrostatic latent image is thus recorded on the photoreceptor surface corresponding to the original image. Development of the electrostatic latent image occurs when charged toner particles are brought into contact with this electrostatic latent image. The charged toner particles will be attracted to the charged regions of the photoreceptor surface that correspond to the electrostatic latent image. In the case of a single step transfer process, the photoreceptor surface with the electrostatically attracted toner particles is then brought into contact with an image receiving surface i.e., paper or other similar substrate. The toner particles are imparted to the image receiving surface by a transferring process wherein an electrostatic field attracts the toner particles towards the image receiving surface causing the toner particles to adhere to the image receiving surface rather than to the photoreceptor. The toner particles then fuse into the image receiving surface by a process of melting and/or pressing. The process is completed when the remaining toner particles are removed from the photoreceptor surface by a cleaning apparatus.

Transferring the toner particles from the photoreceptor surface to the image receiving surface of the substrate is usually performed by applying an electrostatic force field in the transfer nip region sufficient enough to overcome the adhesion force between the toner particles and the photoreceptor surface. If the applied force field is sufficient, the toner particles will move from the photoreceptor surface to the image receiving surface.

The area between the photoreceptor and the image receiving surface may be divided into three distinct regions: the nip region, the pre-nip region, and the post-nip region.

The nip region comprises the point at which the photoreceptor and the image receiving surface come into direct contact. Typically most of the toner particles are transferred to the image receiving surface within the contact nip and at the end of the contact nip, just as the surfaces start to separate. The pre-nip region comprises the region upstream from the nip region. In the pre-nip region, there is an air gap between the photoreceptor and the image receiving surface since the two have not yet come into direct contact. The toner particles are attached to the photoreceptor by adhesion forces, and have not yet come into contact with the image receiving surface. The term "adhesion forces" includes both electrostatic adhesion (e.g., the image force) and non-electrostatic adhesion (e.g., van der Waals forces and capillary forces). The post-nip region is downstream from the nip region. There is also an air gap between the photoreceptor and the image receiving surface in the post-nip region. In this region, the majority of the toner particles typically have been transferred to the image receiving surface and will soon be fused to the image receiving surface.

Precise control over the overall transfer field and the charge on the image receiving surface is desired in each region to ensure the most accurate copy of the original image. The transfer field to attract the toner particles may be highest near the nip region to increase the attraction of the particles away from the photoreceptor. If the field gets too large, however, the transfer efficiency may be reduced because of either the creation of wrong sign toner or an increase in adhesion caused by an induced dipole in the toner particle. Controlling the electric field in the pre-nip region better ensures that the toner particles will not be prematurely attracted away from the photoreceptor to the image receiving surface. Excessive electric fields in the pre-nip region may create gap transfer defects because the toner would transfer prematurely to the image receiving surface introducing undesirable artifacts into the transferred image. Excessive electric fields in the pre-nip region may create wrong sign toner due to air breakdown. The force on the wrong sign toner from the transfer field will tend to increase the attraction of the toner to the photoreceptor. Therefore the toner will not transfer to the image receiving surface. Likewise, the post-nip region also benefits from careful electric field tailoring. Excessive electric fields in the post-nip region may overcharge the transferred toner and deposit damaging positive charge on the photoreceptor. Precise control of the post-nip electric fields can eliminate image disturbances and defects caused by fringe fields and/or uneven arcing between the image receiving surface and either the photoreceptor or the bias transfer roll.

It should thus be seen that a method for precisely tailoring the transfer fields generated in each region is desirable.

The force field applied at the transferring nip region may be generated in several methods. One method, as described in U.S. Pat. No. 2,807,233, positions a transfer corona generator opposite the photoreceptor in the nip region. The transfer corona generator emits ions onto the back of the image receiving surface to cause the toner particles to move onto the image receiving surface. Another method of generating a force field in the transfer nip region comprises a DC charged biased transfer roller or belt rolling along the back of the image receiving surface. When using a biased transfer roller, several different systems are available.

U.S. Pat. No. 3,781,105 discloses the version of the biased transfer roller that is most widely practiced in the xerographic printing industry. The biased transfer roller consists of a relaxable elastomer surrounding a metallic shaft, and does not include any embedded electrodes. The shaft is biased with a constant current high voltage power supply. In principal, partial field tailoring can be achieved by carefully controlling the resistivity of the elastomer, wherein the elastomer must be carefully tuned in order to suppress the pre-nip fields with field tailoring. However, in practice, precisely controlling the elastomer resistivity has not been possible. The resistivity must be controlled within less than a factor of ten (less than an order of magnitude) to ensure successful field tailoring. This is extremely difficult to achieve even when using very expensive elastomers. Part to part variations may exceed this range, and relative humidity can cause the resistivity to shift outside the this range within a given roller. As a result, reliable field tailoring has not been achieved using this method.

The present invention, however, can reliably achieve the desired level of field tailoring with a much wider resistivity latitude for the elastomer. The resistivity latitude if the invention exceeds two orders of magnitude, and relaxable elastomers that can hold this tolerance are easily available.

A fixed transfer block containing spaced and variably biased conductive bars integrally molded into a resistive material to provide tailored image transfer fields is disclosed in U.S. Pat. No. 3,830,589. Transfer rollers containing multiple biased conductors which rotate with the roller are taught in U.S. Pat. No. 3,832,055. U.S. Pat. No. 3,936,174 discloses stationary electrically biased conductive blade-like electrodes inside a thin-walled rotatable outer tube of the biased transfer roller. Each uses the same fundamental method wherein a stationary electrode applies a charge to the surface of the biased transfer roller in a particular transfer region.

The current techniques for creating a transfer field are not adequately tailored for precise control over premature transfer of toner particles from the photoreceptor to the image receiving surface and retransfer.

SUMMARY OF THE INVENTION

In view of the foregoing background, it is an object of the present invention to better control the nip, pre-nip and post-nip fields of high speed xerographic printing. Excessive pre-nip fields can generate wrong sign toner and gap transfer defects. Excessive post-nip fields can overcharge the transferred toner and deposit damaging positive charge onto the photoreceptor.

These and other objects of the present invention are achieved by embedding electrodes into a biased transfer roller. Embedded electrodes may be biased such that the electric fields leading into and out of the nip (transfer) region can be easily and precisely controlled to avoid the beforementioned imaging defects.

The electrodes are embedded onto a biased transfer roller substrate. The electrodes are subsequently surrounded by a conformable semi-conductive layer that can relax the charge accumulated on the surface of the biased transfer roller.

The embedded electrodes may be biased in several different schemes. The electrodes may be grounded in the pre-nip and post-nip regions, but biased in the nip region. All three regions may be biased, or the bias may be varied within each individual region. The bias may even be applied to widely separated electrodes to allow the voltage drop along the semi-conductive surface layer between them to provide the field tailoring. The electrodes far from the nip may be grounded to facilitate the relaxation of charge that has accumulated on the BTR surface.

BRIEF DESCRIPTION OF THE DRAWINGS

Other features of the present invention will become apparent as the following description proceeds and upon reference to the drawings, in which.

DETAILED DESCRIPTION OF PREFERRED EMBODIMENTS

While the embodiments of the present invention are described below, it should be understood that the present invention need not be limited to those embodiments. On the contrary, the present invention is intended to cover all alternatives, modifications, and equivalents as may be included within the spirit and scope of the claims.

The present invention relates to a biased transfer roller onto which the electrodes are embedded. A semi-conductive conformable layer that is able to relax the accumulated charge on the surface of the roller surrounds the embedded electrodes. The embedded electrodes may be biased in various schemes to control the pre-nip and post-nip fields, as well as the nip field.

Figure 1:
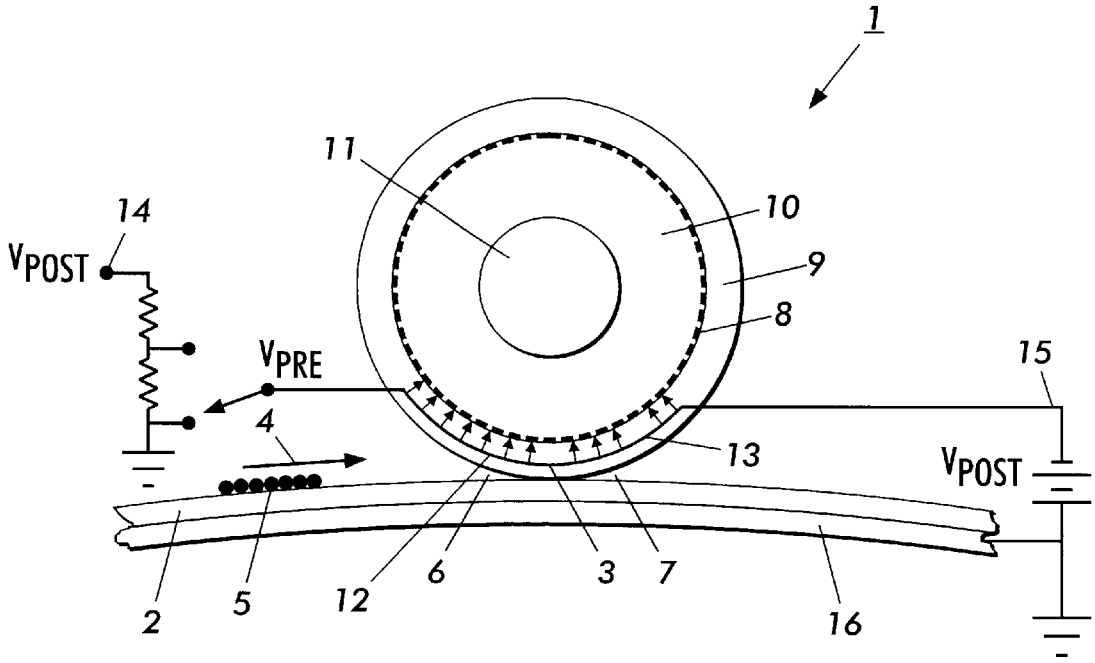
FIG. 1 is an axial cross-sectional view of an electroded biased transfer roller system in accordance with the invention.

FIG. 1 depicts a cross-sectional view of the electroded biased transfer roller system. The biased transfer roller (1) is adjacent to a photoreceptor surface (2) surrounding a photoreceptor ground plane (16). The biased transfer roller and photoreceptor surface come into closest proximity at the nip region (3) where the image is fixed to an image receiving surface (not shown) or other medium such as paper, fabric or intermediate transfer belt moving in the direction indicated by (4). The toner particles (5) are adhered to the photoreceptor surface prior to the nip region.

Upstream from the nip region (3) is the pre-nip region (6). In the pre-nip region (6) there is an air gap between the outer surface of the photoreceptor (2) and the image receiving surface (not shown). The photoreceptor may be either a belt or drum. There is also an air gap between the biased transfer roller (1) and the image receiving surface. There is a corresponding post-nip region (7) downstream from the nip region (3), wherein there is an air gap separating the photoreceptor from the image receiving surface and air gap between the biased transfer roller and the image receiving.

The biased transfer roller (1) comprises numerous commutated longitudinal electrodes (8) embedded on or in the electroded substrate (10). The electroded substrate surrounds a metal shaft (11). The electrodes may be individually charged by different voltages through the stationary pre-nip contact (12) or the stationary post-nip contact (13). The contacts are connected respectively to power sources (14) and (15). The embedded electrodes (8) are surrounded by a thin semi-conductive conformable layer (9).

Figure 2:
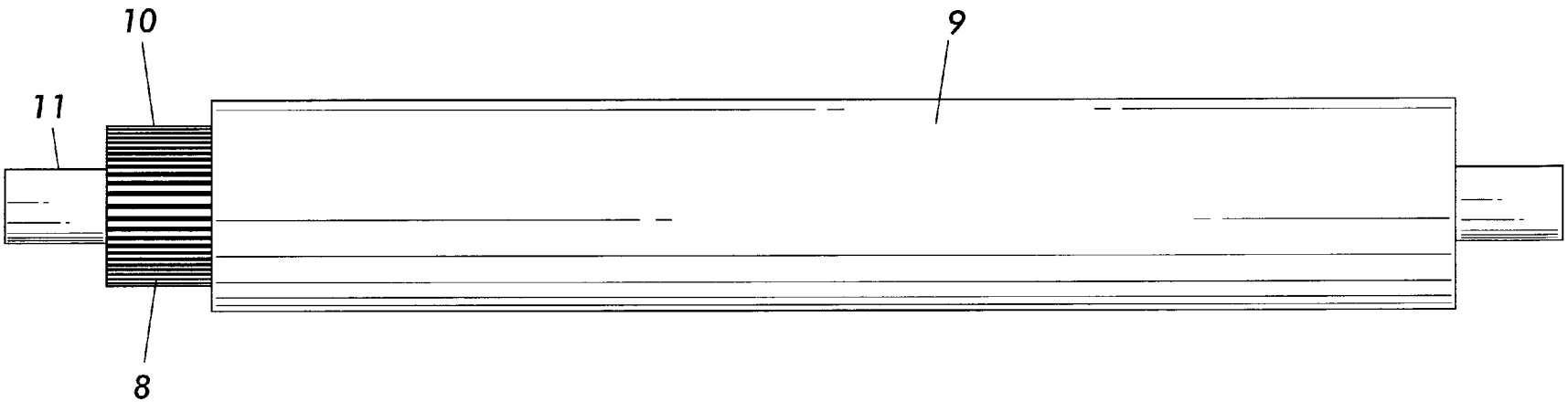
FIG. 2 is a top view of an electroded biased transfer roller in accordance with the invention.

FIG. 2 depicts a top view of the biased transfer roller. The metal shaft (11) is surrounded by the electroded substrate (10). Electrodes (8) are embedded in or on the surface of the substrate, and surrounded by a thin semi-conductive conformable layer (9).

The semi-conductive conformable layer surrounds the embedded electrodes and electroded substrate. The electroded substrate is composed of an insulator material, for example, a polyamide overcoat, but this could also be any good insulating material. The embedded substrate surrounds the metal shaft and has a thickness of, for example, about 0.1 mm to about 20 mm. Typically, the metal shaft may be about 6 to about 10 mm in diameter. The electroded insulating substrate may be about 5 to about 10 mm thick, and the relaxable elastomer may be about 0.2 mm about 1 mm thick.

The embedded electrodes preferably run the length of the roll, although other patterns may also be used. Each of the embedded electrodes are, for example, about 0.05 mm to about 3 mm wide in the process direction (the length of the roll). Preferably, the embedded electrodes are each about 0.2 to about 0.7 mm wide in the process direction. The thickness of the embedded electrode perpendicular to the surface is preferably less than, for example, about 50 microns. Further, the embedded electrodes are preferably spaced apart from one another in a regular pattern such that there is an about 0.05 mm to about 3 mm gap between each embedded electrode on the surface of the insulating substrate. Preferably, the gap between each embedded electrode is about 0.2 mm to about 0.7 mm. This size and gap space should be such to allow the embedded electrodes to be close enough to each other to ensure precise control over the electric fields generated, yet far enough apart to limit the current flow between individual embedded electrodes.

The embedded electrodes are located on the surface of the insulating substrate layer. This layer preferably extends beyond the semi-conductive conformable layer. The shaft, in turn, preferably extends beyond the substrate layer. The high voltage bias supply contacts the exposed embedded electrodes through stationary electrodes, for example, conductive brushes. The bias power supply unit may be controlled via a device implementing a pre-programmed control routine (e.g., a computer or the like). The power supply for the electrodes may be DC, AC or DC biased AC. Further, the power supply may be constant current.

The semi-conductive layer must be resistive enough to limit current flow between the embedded electrodes. However, the semi-conductive layer must also be conductive enough to ensure that the charge generated and deposited on the biased transfer roller surface can quickly relax.

Preferably, the semi-conductive conformable layer comprises a flexible elastomer. The elastomer should preferably be flexible enough to form a fairly uniform contact nip along the full length of the roller. The Shore O hardness may preferably range from, for example, 0 to about 100, but typically is from about 15 to about 80. The elastomer may be, for example, urethane rubber, epichlorhydrin elastomers, EPDM rubber, styrene butadiene rubber, fluoro-elastomers or silicone rubber. The materials may be doped with either ionic species or conductive fillers to vary the resistivity of the elastomer. The semi-conductive conformable layer may have any suitable thickness such as, for example, about 0.02 mm to about 10 mm, preferably from about 0.2 mm to about 1 mm.

In a preferred embodiment, the semi-conductive layer will have a relaxation time of about $0.3\times(W_{NIP}/V_{PROCESS})$ where $W_{NIP}$ is the width of the nip, and $V_{PROCESS}$ is the speed the xerography process. A typical process speed is about 250 mm/s (about 60 pages per minute), although the present invention may be used at higher (>300 mm/s) or lower speeds. Preferably, $W_{NIP}$ is about 0.05 to about 6 mm, typically about 0.05 mm to about 3 mm. $V_{PROCESS}$ may be from about 25 mm/s to about 1250 mm/s.

Further, the semi-conductive conformable layer must be thick enough to avoid dielectric breakdown ($E_{BREAK}$) under bias leak (short to ground) conditions. Preferably, the $E_{BREAK}$ value is as large as possible. The breakdown field should exceed 1 V/micron, but values exceeding 100 V/micron may be necessary for thinner elastomers. However, the semi-conductive conformable layer must also be thin enough to allow control over the pre-nip and post-nip fields. The semi-conductive conformable layer may have a resistivity ($\rho$) of, for example, about $10^5$ to about $10^{13}$ $\Omega$-cm in this calculation.

The voltages of each region may be varied depending upon the desired effect upon the xerography process. The $V_{NIP}$, $V_{PRENIP}$, and $V_{POSTNIP}$ may have a voltage range from about −10,000 V to about 10,000 V or more depending on the charge sign of the toner.

$I_{MAX}$ is the maximum current that the power source may supply. A high current may be drawn if either the adjacent electrodes are biased at significantly different potentials, or if a photoreceptor belt or drum has a pinhole failure (i.e., a small permanent spot on the photoconductor which has a very low resistance to ground) and the biased transfer roller shorts to ground. The maximum current ($I_{MAX}$) may typically be about 2 mA to about 3 mA, but may be any suitable value, including, for example, 10 mA or 20 mA or larger.

In one embodiment, $V_{PROCESS}$ is about 250 mm/s. The $V_{PRENIP}$ and $V_{POSTNIP}$ are both about 0 V, and $V_{NIP}$ is about 1500 V. The $I_{MAX}$ is about 1 mA, and $E_{BREAK}$ is about 5 V/micron. If the embedded electrodes are separated by about 0.5 mm, and the thickness of the semi-conductive layer is about 0.3 mm to about 0.5 mm, then the resistivity of the semi-conductive layer under these stressful conditions is about $3\times10^7$ $\Omega$-cm to about $3\times10^9$ $\Omega$-cm. This is a relatively wide resistivity latitude, and there are many relaxable elastomers that can hold this tolerance.

When the resistivity is in the above preferred range, the charge on the semi-conductive layer should relax within a time scale of less than about 1 mm/$V_{PROCESS}$ where $V_{PROCESS}$ is the speed the xerography process. Because the relaxation time is so small, grounding some of the electrodes further from the nip is probably unnecessary. However, some of the electrodes further from the nip may nonetheless be grounded to prevent cyclic buildup of the charge deposited on the semi-layer surface.

The biased transfer roller may further include a cleaner comprising a blade, a pad, or a brush cleaner (or any other type of cleaner) in order to minimize contamination of the biased transfer roller with toner particles. The cleaner, if present, is located outside the pre-nip and post-nip regions.

The electroded biased transfer roller may be present in any xerographic system including those that employ a conventional biased transfer roller. Thus, the present invention may be applied to effect toner transfer from either a drum or belt photoreceptor to either an intermediate belt or to the final substrate (e.g., paper or transparency). It may also be used for toner transfer between intermediate belts (belt to belt, e.g., for multi belt configurations) or from an intermediate drum or belt to either an intermediate belt, the final substrate or any other image receiving substrate.

The electroded biased transfer roller may be located in an area in an image transfer zone adjacent to where an image receiving substrate would pass through the image transfer zone and opposite an image bearing member surface, e.g., photoreceptor, intermediate belt or drum, etc. The image receiving substrate passes between the biased transfer roller and the image bearing surface at or near an image transfer zone, i.e., the transfer nip. The electroded biased transfer roller is thus at a backside of the image receiving substrate, enabling the toner image to be transferred from the image bearing member's surface to the frontside surface of the image receiving substrate in the image transfer zone. The image receiving substrate may be fed into the image transfer zone on a belt such as a paper escort belt or a transfer belt, which belt also passes between the electroded biased transfer roller and image bearing member in a manner that the belt contacts the electroded biased transfer roller and the frontside surface of the image receiving substrate contacts the image bearing member.

The electroded biased transfer roller may vary the biasing scheme of the system. For example, all the electrodes in the pre-nip and post-nip regions may be grounded, but the electrodes in the nip region may be biased at high voltage. There are other possible biasing schemes including, but not limited to, the following examples.

The bias of the electrodes in the pre-nip, nip, and post-nip regions may all be varied. The bias may be varied within the pre-nip, post-nip, and/or nip regions of the biased transfer roller. Each electrode may be biased separately, or groups of electrodes may be biased to the same potential. The bias may also be applied to widely separated electrodes wherein the voltage is allowed to drop along the semi-conductive surface layer between the biased electrodes in order to provide the field tailoring.

What is claimed is:

1. An electroded biased transfer roller for transfer of a xerographic image, comprising:

a metal shaft;

an insulating substrate upon the metal shaft;

a plurality of embedded electrodes located upon the substrate; and a conformable semi-conductive layer surrounding the plurality of embedded electrodes, wherein the conformable semi-conductive layer provides enough resistance to limit current flow between the embedded electrodes and conductive enough to ensure that the charge generated and deposited on the biased transfer roller surface can quickly relax.

2. The electroded biased transfer roller according to claim 1, wherein the embedded electrodes are deposited onto the insulating substrate, and surrounded by the conformable semi-conductive layer, wherein the substrate extends beyond the semi-conductive layer at one end of the shaft and electrically biased stationary electrodes contact the embedded electrodes to provide the bias.

3. The electroded biased transfer roller according to claim 1, wherein the conformable semi-conductive layer comprises a flexible elastomer having a Shore O hardness from 0 to about 100.

4. The electroded biased transfer roller according to claim 1, wherein the conformable semi-conductive layer has a thickness of about 0.02 mm to about 10 mm.

5. The electroded biased transfer roller according to claim 1, wherein the plurality of embedded electrodes are separated from one another by about 0.05 mm to about 3 mm.

6. The electrodes biased transfer roller according to claim 1, further comprising a biased transfer cleaner, the biased transfer roller cleaner is at least one of a blade, a pad, and brush cleaner.

7. The electroded biased transfer roller according to claim 1, wherein the conformable semi-conductive layer exhibits an approximate relaxation time of a charge deposited on an outer surface of the biased transfer roller calculated by $$0.3\times(W_{NIP}/V_{PROCESS})$$

where $W_{NIP}$ is a width of a nip region and $V_{PROCESS}$ is a speed of the xerographic process.

8. The electroded biased transfer roller according to claim 7, wherein the $W_{NIP}$ is from about 0.05 mm to about 6 mm.

9. The electroded biased transfer roller according to claim 7, wherein the conformable semi-conductive layer has a resistivity from about $10^5$ Ω-cm to about $10^{13}$ Ω-cm.

10. The electroded biased transfer roller according to claim 7, wherein the charge relaxes within a time scale less than about 1 mm/$V_{PROCESS}$.

11. The electroded biased transfer roller according to claim 1, wherein each of the plurality of embedded electrodes is about 0.05 mm to about 3 mm wide in the process direction.

12. The electroded biased transfer roller according to claim 1, wherein the substrate has a thickness of about 0.1 mm to about 20 mm.

13. The electroded biased transfer roller according to claim 1, wherein a voltage in each of a nip region, a pre-nip region and a post-nip region is about −10,000 V to about 10,000 V, depending upon a charge sign of a toner.

14. A process of biasing an electroded biased transfer roller for transfer of a xerographic image comprising the electroded bias transfer roller of claim 1, comprising biasing the electrodes in a nip region and grounding the electrodes in pre-nip and post-nip regions.

15. A process of biasing an electroded biased transfer roller for transfer of a xerographic image comprising the electroded bias transfer roller of claim 1, comprising biasing the electrodes in a pre-nip, a post-nip, and a nip region.

16. The process according to claim 15, wherein the biasing of the electrodes in pre-nip, post-nip, and nip regions is varied.

17. The process according to claim 15, wherein the biasing is applied to widely separated electrodes and allows the voltage drop along the semi-conductive surface layer between them to provide the field tailoring.

18. A device for producing xerographical images comprising the electroded biased transfer roller of claim 1.

19. The device according to claim 18, further comprising an intermediate belt or drum located adjacent to the biased transfer roller at the point of transfer of toner particles from the intermediate belt or drum surface to an image receiving substrate.

20. The device according to claim 18, further comprising a photoreceptor belt or drum located adjacent to the biased transfer roller at the point of transfer of toner particles from the photoreceptor belt or drum to an intermediate belt or drum surface, or to an image receiving substrate.

21. The device according to claim 18, wherein the electroded biased transfer roller is located in an image transfer zone at an area adjacent to where an image receiving substrate would pass through the image transfer zone and opposite an image bearing member.

22. The device according to claim 21, further comprising a belt for supporting and feeding the image receiving substrate through the image transfer zone.

* * * * *